US006201202B1

(12) United States Patent
Katagiri

(10) Patent No.: US 6,201,202 B1
(45) **Date of Patent: *Mar. 13, 2001**

(54) SWITCH OPERATING RUBBER MEMBER AND SWITCH DEVICE

(75) Inventor: Moriya Katagiri, Tokyo (JP)

(73) Assignee: Olympus Optical Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 10 days.

(21) Appl. No.: 09/376,806

(22) Filed: Aug. 18, 1999

(30) Foreign Application Priority Data

Aug. 20, 1998 (JP) ..... 10-234524

(51) Int. Cl.[7] ..... H01H 13/14
(52) U.S. Cl. ..... 200/513; 200/517; 200/343
(58) Field of Search ..... 200/1 B, 5 R, 200/5 A, 512, 513, 516, 517, 341, 343–345; 400/472, 490, 491, 491.2, 495, 495.1, 496

(56) References Cited

U.S. PATENT DOCUMENTS 3,982,081 * 9/1976 Demler, Jr. ..... 200/5 R
4,190,748 * 2/1980 Langford ..... 200/5 A
4,492,829 * 1/1985 Rodrique ..... 200/5 A
4,687,200 * 8/1987 Shirai ..... 273/148 B
4,766,271 * 8/1988 Mitsuhashi et al. ..... 200/159 B
5,278,374 * 1/1994 Takagi et al. ..... 200/513
5,874,697 * 2/1999 Selker et al. ..... 200/5 A

* cited by examiner

*Primary Examiner*—Michael Friedhofer
(74) *Attorney, Agent, or Firm*—Ostrolenk, Faber, Gerb & Soffen, LLP

(57) ABSTRACT

A switch device turns ON and OFF the contact pattrns of a switch substrate by pressing an operating button and turning the turning plate section of an operating rubber member serving as a switch operating rubber member. The turning plate section is turnably supported on a substrate section by a hinge section, and the periphery of the turning plate section other than the hinge section is coupled with the substrate section by a thin film section. The operating button presses the turning plate section at a position near the hinge section. An electrically conductive rubber, which comes into contact with the contact pattern under pressure, is bonded to the turning plate section at a position distanced from the position at which the operating button presses the turning plate. As a result, the operating stroke distance of the switch can be decreased, and also the thickness of a switch mechanical unit can be reduced in the stroke direction.

21 Claims, 4 Drawing Sheets

SWITCH OPERATING RUBBER MEMBER AND SWITCH DEVICE

BACKGROUND OF THE INVENTION

1. Field of the Invention

The present invention relates to the structure of a switch operating rubber member for pressing a switch section composed of an electrically conductive section and a pattern on a substrate.

2. Description of the Related Art

FIGS. 9, 10A and 10B show cross-sectional views of the structure of a push type switch as an example of conventional push type switches. The push type switch mainly comprises main bodies 51 and 61, operation buttons 52 and 62 which are movable in an up and down direction, diaphragm 53 and 63, and printed circuit boards 55 and 65 having electrical contacts 55*a* and 65*a*. In this push switch, when the operation buttons 52 and 62 are pressed, the electrically conductive rubbers 54 and 64 come into contact with the electrical contacts 55*a* and 65*a*, whereby an ON signal is output.

However, in the push type switch shown in FIG. 9, the stroke of the operation button 52 is determined by the contact pattern disposed below it such that the switch cannot be operated by pressing the button through a stroke having a length other than a predetermined amount. Further, it is difficult to dispose the switch in a thin space because the diaphragm 53, the electrically conductive rubber 54 and the printed circuit board 55 are disposed below the operation button in an overlapped state.

Further, in the push type switch shown in FIGS. 10A and 10B, when the operation button 62 is pressed as shown in FIG. 10B, which shows the turned-ON state of the switch, there is a possibility that the diaphragm 63 is unevenly flexed and the operation button 62 is inclined. When the operation button 62 is inclined, there is a possibility for the occurrence of a disadvantage in which the operation button 62 is caught by the inner wall of the main body 61 so that the operation button 62 cannot be returned to its original position even if the pressing force is released therefrom. Conventionally, it is an ordinary practice to make the operation button guide section of the main body 61 thicker toward the outside as well as to increase the length of the operation button 62 to prevent the operation button 62 from becoming caught under the main body, which makes the miniaturization of such equipment difficult.

SUMMARY OF THE INVENTION

An object of the present invention, which was made to solve the aforesaid disadvantage, is to provide a switch operating rubber member or a switch device by which a switch operating stroke can be decreased or increased, the thickness of a switch mechanical unit can be reduced and the drawback in which the operation button cannot be returned to its original position can be prevented.

A switch operating rubber member of the present invention is deformed upon being pressed to operate a switch by causing electrical contacts to contact each other to thereby enable electrical conduction therebetween. The switch operating rubber member comprises an approximately flat-sheet-shaped substrate section; a turning section which turns with respect to the substrate section by being pressed when the switch is pressed; a first coupling section which elastically deforms with respect to the substrate section when the turning section is turned for coupling the substrate section with the turning section along the turning axis thereof; a second coupling section which elastically deforms with respect to the substrate section in association with the turning motion of the turning section for coupling the substrate section with the turning section at the displacing portion thereof which is distanced from the turning axis, wherein when the turning section is pressed, the turning section is turned because the first coupling section acts as the turning axis of the turning section by being elastically deformed, and the second coupling section is flexed to a greater extent than the first coupling section to thereby permit the turning motion of the turning section.

Further, a switch device of the present invention comprises a swing support section composed of a rubber material; a swing section composed of a rubber material and swingably turnable with respect to the swing support section, the swing section including a portion to be pressed and also a contact portion. In the switch device, when the portion to be pressed is pressed, the swing section is swung and turned to thereby cause the contact portion to come into contact with electrical contacts, whereby the turned-ON state of the switch device can be obtained.

Other features and advantages of the present invention will become more apparent from the following description when taken in conjunction with the accompanying drawings.

DESCRIPTION OF THE PREFERRED EMBODIMENTS

Embodiments of the present invention will be described below with reference to the accompanying drawings.

Figure 1:
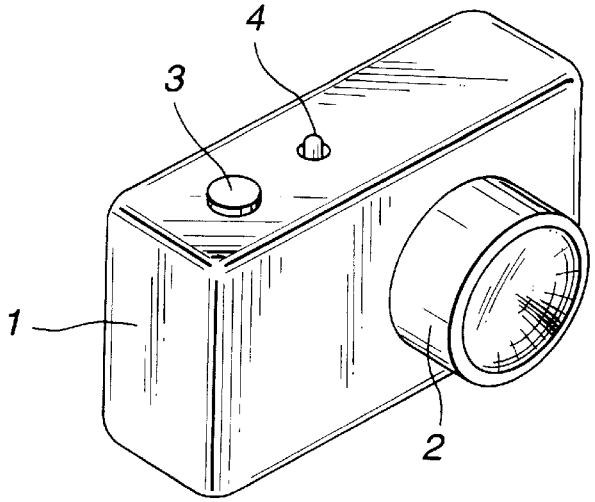
FIG. 1 is a perspective view showing the outward appearance of a camera containing a switch which incorporates a switch operating rubber member of a first embodiment of the present invention.
Figure 2:
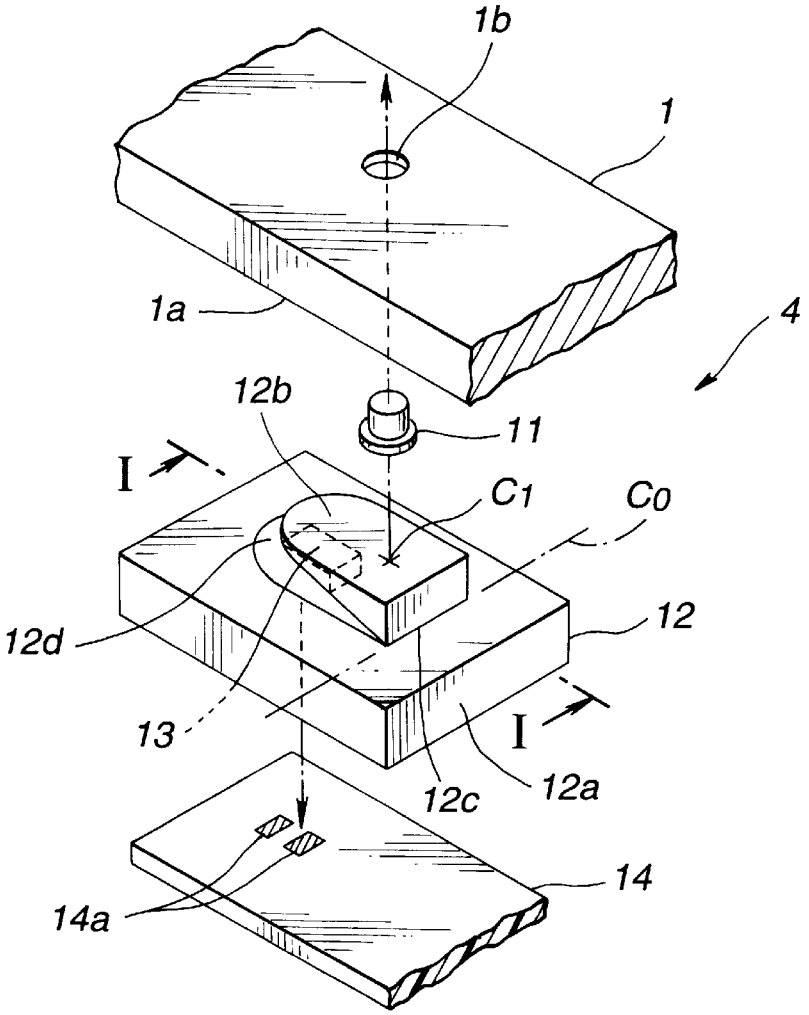
FIG. 2 is an exploded perspective view of the switch incorporated in the camera shown in FIG. 1.
Figure 3:
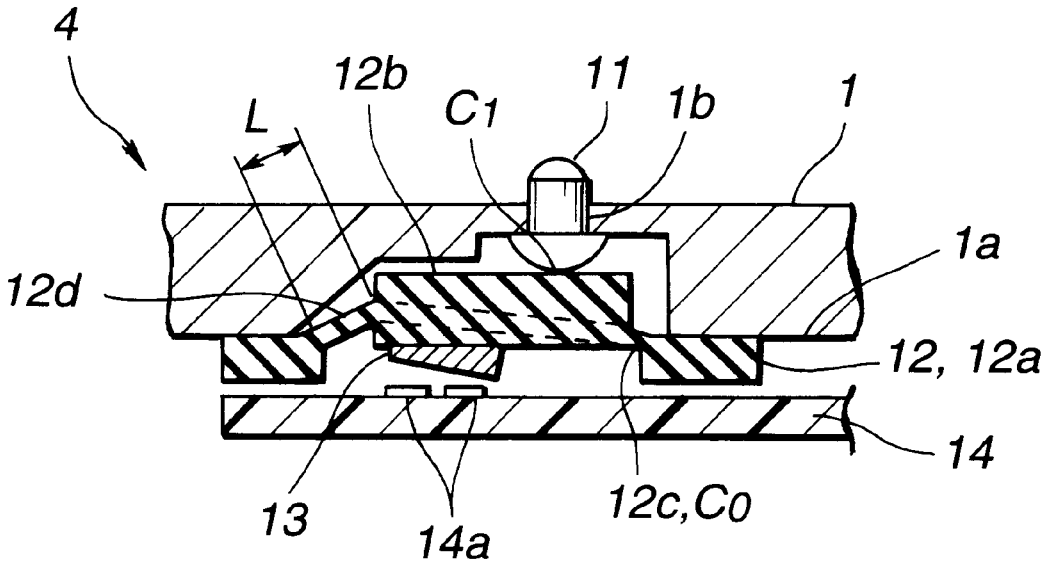
FIG. 3 is a cross-sectional view taken along the line I—I in the lengthwise direction of the switch shown in FIG. 2 and shows the switch in a turned-OFF state.
Figure 4:
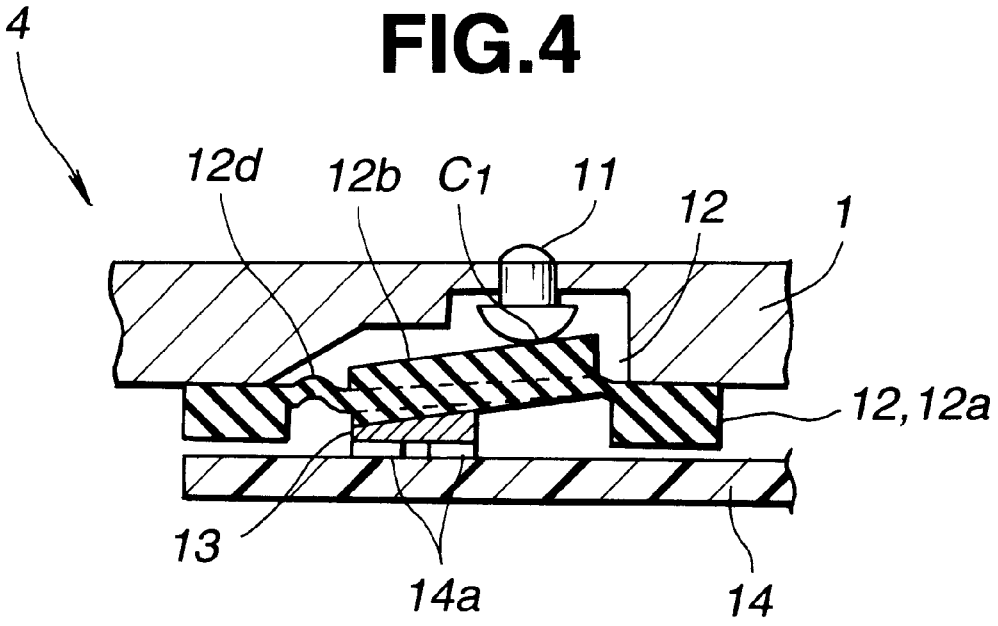
FIG. 4 is a cross-sectional view taken along the line I—I in the lengthwise direction of the switch shown in FIG. 2 and shows the switch in a turned-ON state.

FIG. 1 is a perspective view of a camera in which a switch 4, which includes a switch operating rubber member of a first embodiment of the present invention, is assembled, FIG. 2 is an exploded perspective view of the switch 4, FIG. 3 is a cross-sectional view taken along the line I—I in the lengthwise direction of the switch 4 shown in FIG. 2 and shows the switch in a turned-OFF state, and FIG. 4 is a cross-sectional view taken along the line I—I in the lengthwise direction of the switch shown in FIG. 2 similarly to FIG. 3 and shows the switch in a turned-ON state.

As shown in FIG. 1, the camera includes a photographing lens barrel 2 disposed on the front surface of the main body 1 thereof and a release switch 3, the switch 4, which is used to set various modes and the like, disposed on the upper surface of the main body 1.

As shown in FIG. 2, the switch 4 mainly comprises the rubber member pressing section 1*a* of the main body 1 including an operating button insertion hole 1*b*, an operating button 11, an operating rubber member 12 serving as a switch operating rubber member, an electrically conductive rubber 13 bonded to the operating rubber member and a switch substrate 14 including switch contact patterns 14*a*.

The operating rubber member 12 is formed of silicone rubber. As shown in FIGS. 2 to 4, the operating rubber member 12 comprises an approximately flat-sheet-shaped substrate section 12*a*, a turning plate section 12*b* serving as a turning section, an elastically deformable hinge section 12*c* serving as a first linear coupling section and an elastically deformable thin film section 12*d*. The substrate section 12*a* is bonded and fixed to the rubber member pressing section 1*a* of the main body 1. The hinge section 12*c* is interposed between the substrate section 12*a* and the turning plate section 12*b* and formed along the turning axis C0 of the turning plate section 12*b*. The thin film section 12*d* is a second thin-film-shaped coupling section for coupling the substrate section 12*a* with the turning plate section 12*b*.

The thin film section 12*d* is formed of a conical surface (more precisely, a portion of a conical surface and an inclined surface) connected around the periphery of the turning plate section 12*b* excluding the hinge section 12*c*. The length of the actuating line L of the conical surface or the width of the inclined surface increases according to the distance of a position along the periphery of the turning plate relative to the hinge section 12*c*. Further, the hinge section 12*c* is not necessarily continuous and may only connect the turning plate section to the substrate section 12*a* at the ends of the turning plate section 12*b*.

The operating button 11 is slidably inserted into the operating button inserting hole 1*b* and abutted against a press point C1 near the hinge section 12*c* (turning axis C0) of the turning plate section 12*b* of the operating rubber member 12. Further, the electrically conductive rubber 13 is formed on the lower surface of the turning plate section 12*b* integrally therewith at a region opposite to the hinge section 12*c* with respect to the press point C1 of the operating button.

Contact patterns 14*a* are disposed on the switch substrate below the electrically conductive rubber 13, and the surface of the electrically conductive rubber 13 is inclined so as to be parallel with the contact patterns 14*a* when the turning plate section 12*b* is turned (pressed downward).

How the switch 4 arranged as described above is turned ON and OFF will now be described. When the operating button 11 is not being pressed, the turning plate section 12*b* of the operating rubber member 12 is urged upward by the elastic urging force of the hinge section 12*c* and is positioned as shown in FIG. 3. The electrically conductive rubber 13 is spaced apart from the contact patterns 14*a*, and the switch 4 is in a turned-OFF state.

When the operating button 11 is pressed, the turning plate section 12*b* is turned by the operating button 11 about the turning axis C0 as shown in FIG. 4 so that the electrically conductive rubber 13, which is located on a region opposite to the hinge, comes into contact with the contact patterns 14*a*, whereby the switch 4 is in a turned-ON state.

According to the switch 4, to which the operating rubber member 12 of the first embodiment is applied, since the electrically conductive rubber can be moved by the increased pressure of the operating button 11, the stroke distance of the operating button 11 can be reduced. Further, the thickness of the switch can be reduced in its pressing direction because no electrically conductive rubber is disposed below the operating button 11.

Since the periphery of the operating button 11 is isolated from the periphery of the switch substrate 14 in the main body of the operating rubber member 12, waterproof processing can be easily carried out. Further, since the operating button 11 is distanced from the electrically conductive rubber 13 and the contact patterns 14*a*, it is not always necessary to dispose the switch contact pattern section below the operating button 11, whereby the degree of freedom of layout is increased in the main body 1.

While the switch 4 uses the electrically conductive rubber 13 as an electrically conductive means, a metal piece may be disposed on the contact patterns 14*a* so that the contact patterns 14*a* may be conducted by pressing the metal piece with the turning plate section 12*b*. The hinge section 12*c* of the operating rubber member 12 is formed on a straight line. However, the hinge section 12*c* may be located at only one position at the center of the turning axis C0. (Otherwise) In another alternative, the hinge section 12*c* may be located at the two end positions along the turning axis C0 of the turning plate section 12*b*.

Figure 5:
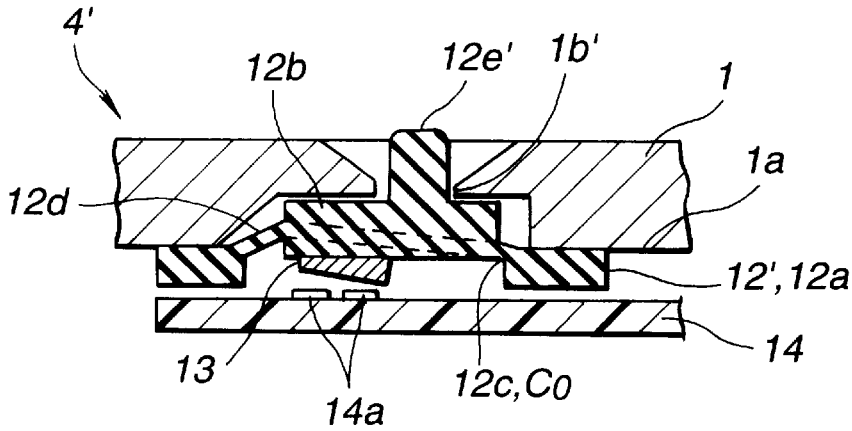
FIG. 5 shows a longitudinal cross-sectional view (corresponding to the I—I cross-sectional view) of a switch which is a modification of the switch shown in FIG. 2 and shows the switch in a turned-OFF state.
Figure 6:
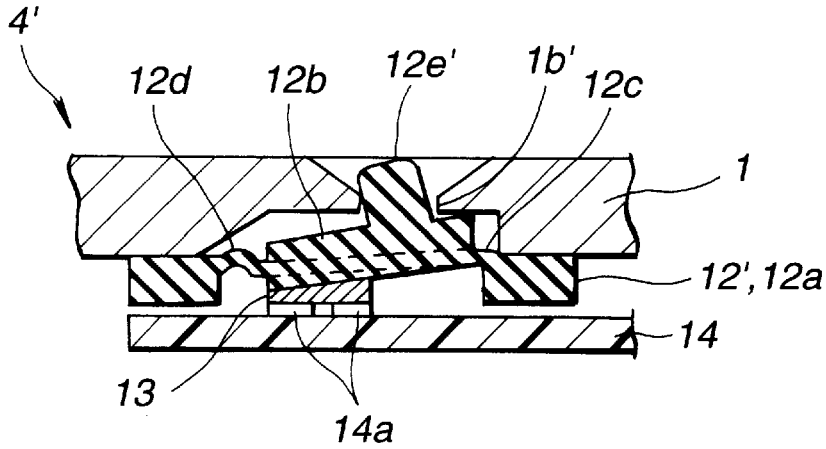
FIG. 6 shows a longitudinal cross-sectional view (corresponding to the I—I cross-sectional view) of the switch which is the modification shown in FIG. 5 and shows the switch in a turned-ON state.

Next, a modification of the switch 4 shown in FIG. 2 will be described. In the switch of the modification, the operating rubber member 12 is formed integrally with the operating button 11. FIGS. 5 and 6 are longitudinal cross-sectional views of the switch 4' of the modification when it is turned OFF and ON (cross-sectional view corresponding to the line I—I in FIG. 2).

As shown in FIGS. 5 and 6, in the operating rubber member 12' of the switch 4', an operating button section 12*e'* is integrally formed with a turning plate section 12*b*. An inserting hole 1*b'*, into which the operating button section 12*e'* is loosely inserted, is formed in a main body 1. Other portions of the switch 4' are similar to those of the switch 4.

In the switch 4', when the operating button section 12*e'* is pressed in a similar manner as with the switch 4, the turning plate section 12*b* is turned about a turning axis C0 as shown in FIG. 6 to thereby cause an electrically conductive rubber 13, which is located on a region opposite to the hinge section, to come into contact with contact patterns 14*a*, whereby the switch 4' is turned ON.

According to the switch 4' of the modification, an effect similar to that of the switch 4 can be achieved. In addition, since the operating button section 12*e*' is formed integrally with the operating rubber member 12', the number of components can be reduced and also the switch 4' can be easily assembled.

Figure 7:
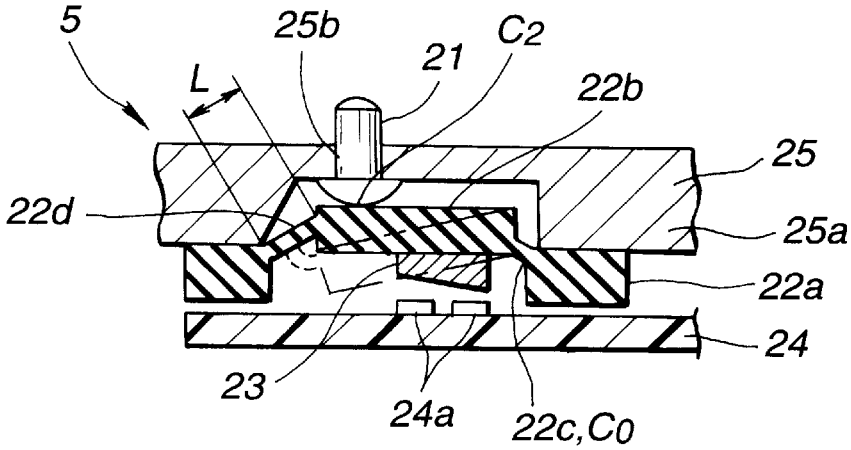
FIG. 7 is a longitudinal cross-sectional view along the lengthwise direction of a switch which incorporates a switch operating rubber member of a second embodiment of the present invention and shows the switch in a turned-OFF state.

Next, a switch 5, which incorporates a switch operating rubber member of a second embodiment of the present invention, will be described. FIG. 7 is a longitudinal cross-sectional view along the lengthwise direction of the switch 5 and shows the switch in a turned-OFF state.

As shown in FIG. 7, the switch 5 mainly comprises the rubber member pressing section 25*a* of a main body 25 including an operating button inserting hole 25*b*, an operating button 21, an operating rubber member 22 serving as a switch operating rubber member, an electrically conductive rubber 23 formed integrally with the operating rubber member and a switch substrate 24 including switch contact patterns 24*a*.

The operating rubber member 22 is formed of silicone rubber similarly to the operating rubber member 12 of the first embodiment. As shown in FIG. 7, the operating rubber member 22 comprises an approximately flat-sheet-shaped substrate section 22*a*, a turning plate section 22*b* serving as a turning section, an elastically deformable hinge section 22*c* serving as a first linear coupling section and an elastically deformable thin film section 22*d*. The substrate section 22*a* is bonded and fixed to the rubber member pressing section 25*a* of the main body 25. The hinge section 22*c* is interposed between the substrate section 22*a* and the turning plate section 22*b* and formed along the turning axis C0 of the turning plate section 22*b*. The thin film section 22*d* is a second thin-film-shaped coupling section for coupling the substrate section 22*a* with the turning plate section 22*b*. The respective components of the operating rubber member 22 are formed with shapes similar to those of the components of the aforesaid operating rubber member 12.

The switch 5 is different from the switch 4 of the first embodiment in that the operating button 21, which is slidably inserted into the operating button inserting hole 25*b*, is abutted against a press point C2 located at a position far from the hinge section 22*c* (turning axis C0) of the turning plate section 22*b* of the operating rubber member. In this embodiment, the electrically conductive rubber 23 is formed on the lower surface of the turning plate section 22*b* integrally therewith at a position which is nearer to the hinge section 22*c* (turning axis C0) than the press point C2.

How the switch 5 of the second embodiment arranged as described above is turned ON and OFF will now be described. When the operating button 21 is not being pressed, the turning plate section 22*b* of the operating rubber member 22 is urged upward by the elastic urging force of the hinge section 22*c* and is positioned as shown in FIG. 7. The electrically conductive rubber 23 is spaced apart from the contact patterns 24*a*, and the switch 5 is in a turned-OFF state.

When the operating button 21 is pressed, the turning plate section 22*b* is turned by the operating button 21 about the hinge section 22*c* (the turning axis C0) so that the electrically conductive rubber 23 located on the hinge section side comes into contact with the contact patterns 24*a*, and the switch 5 is in a turned-ON state.

According to the switch 5 which incorporates the operating rubber member 22 of the second embodiment, since the turning plate section 22*b* is pressed by the operating button 21 at a position far from the hinge section 22*c*, the operating stroke distance of the switch is increased and operating force is reduced, whereby the switch can be easily operated. Further, there can be obtained an effect in which the thickness of a switch mechanical unit can be reduced with respect to the stroke of the switch.

Figure 8:
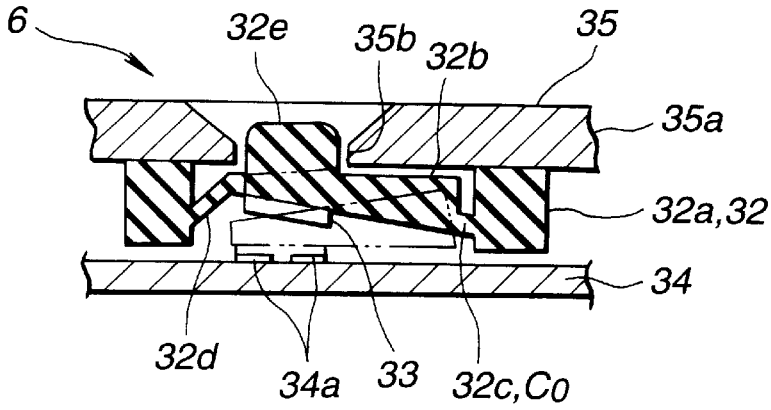
FIG. 8 is a longitudinal cross-sectional view along the lengthwise direction of a switch which incorporates a switch operating rubber member of a third embodiment of the present invention and shows the switch in a turned-OFF state.
Figure 9:
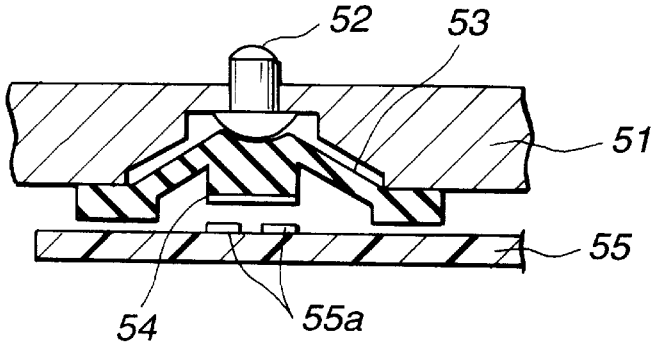
FIG.9 RELATED ART
FIG. 9 is a longitudinal cross-sectional view of a switch which incorporates a conventional switch operating rubber member and shows the switch in a turned-OFF state.
Figure 10A:
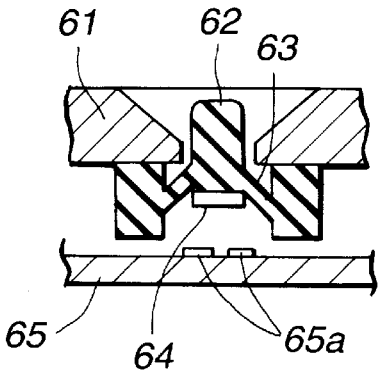
FIG.10(A) RELATED ART
FIG. 10A is a longitudinal cross-sectional view of a switch which incorporates another conventional switch operating rubber member and shows the switch in a turned-OFF state.
Figure 10B:
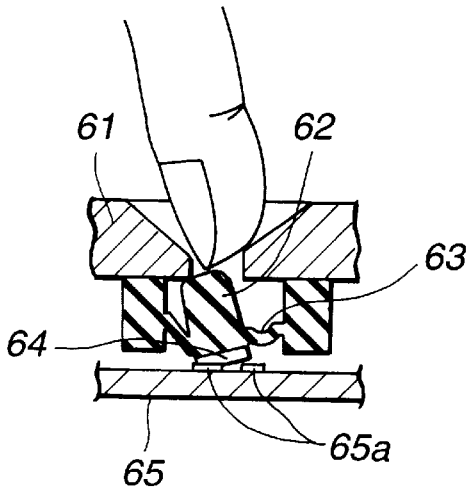
FIG.10(B) RELATED ART
FIG. 10B is a longitudinal cross-sectional view of the switch which incorporates the conventional switch operating rubber member of FIG. 10A and shows the switch in a turned-ON state.

Next, a switch 6 which incorporates a switch operating rubber member of a third embodiment of the present invention will be described. FIG. 8 is a longitudinal cross-sectional view of the switch 6 taken along the lengthwise direction thereof and shows that the switch 6 is turned OFF.

As shown in FIG. 8, the switch 6 mainly comprises the rubber member pressing section 35*a* of a main body 35 including an operating button inserting hole 35*b*, an operating rubber member 32 serving as a switch operating rubber member, an electrically conductive rubber 33 formed integrally with the operating rubber member 32 and a switch substrate 34 including switch contact patterns 34*a*.

The operating rubber member 32 is formed of a silicone rubber similarly to the operating rubber member 12 of the first embodiment. As shown in FIG. 8, the operating rubber member 32 comprises an approximately flat-sheet-shaped substrate section 32*a*, a turning plate section 32*b*, an elastically deformable hinge section 32*c* serving as a first linear coupling section, an elastically deformable thin film section 32*d* and an operating section 32*e*. The substrate section 32*a* is bonded and fixed to the rubber member pressing section 35*a* of the main body 35. The hinge section 32*c* is interposed between the substrate section 32*a* and the turning plate section 32*b* and formed along the turning axis C0 of the turning plate section 32*b*. The thin film section 32*d* is a second thin-film shaped coupling section for coupling the substrate section 32*a* with the turning plate section 32*b*. The operating section 32*e* is inserted into the operating button inserting hole 35*b* of the main body 35 and pressed when it is operated to thereby turn the turning plate section 32*b*.

How the switch 6 of the third embodiment arranged as described above is turned ON and OFF will now be described. When the operating section 32*e* is not being pressed, the turning plate section 32*b* of the operating rubber member 32 is urged upward by the elastic urging force of the hinge section 32*c* and the thin film section 32*d* and is positioned as shown in FIG. 8. The electrically conductive rubber 33 is spaced apart from the contact patterns 34*a*, and the switch 6 is a turned-OFF state.

When the operating section 32*e* is pressed, the turning plate section 32*b* of the operating rubber member 32 is turned about the hinge section 32*c* (turning axis C0) to thereby cause the electrically conductive rubber 33 to come into contact with the switch contact patterns 34*a*, whereby the switch 6 is turned ON. At this time, the turning plate section 32*b* is turned about the linearly formed hinge section 32*c* (turning axis C0) and is not inclined in a direction other than the turning direction. Thus, the operating section 32*e* does not become caught in the inserting hole 35*b* of the main body.

According to the switch 6 which incorporates the operating rubber member 32 of the third embodiment, the drawback in which the operating section 32*e* is caught in the inserting hole 35*b* of the main body and cannot be returned to its original position can be prevented without increasing the size of the equipment.

According to the switches which incorporates the switch operating rubber members of the aforesaid respective embodiments, the operating stroke distance of the switches can be decreased or increased, and also the thickness of the switch mechanical unit can be reduced in the direction of the stroke, whereby the drawback in which the operating buttons do not return to their original position is not encountered.

What is claimed is:

1. A switch operating rubber member operatively provided in a housing which is deformed by being pressed when a switch is operated and causes electrical contacts to contact with each other to thereby allow electrical conduction therebetween, comprising:

a housing section having an operating button hole formed therein;

an approximately flat-sheet-shaped substrate section;

a turning section which turns with respect to the substrate section upon being pressed when the switch is operated;

an operating button which extends through the operating button hole, for pressing the turning section to operate the switch when the operating button is pressed;

a first coupling section which elastically deforms with respect to the substrate section when said turning section is turned, for coupling the substrate section with said turning section along a turning axis thereof; and a second coupling section which elastically deforms with respect to the substrate section in association with the turning motion of said turning section, for coupling the substrate section with said turning section around the periphery of said turning section other than along said turning axis, wherein when said turning section is pressed, said turning section is turned because said first coupling section elastically deforms along said turning axis of said turning section, and said second coupling section flexes to a greater extent than said first coupling section to thereby permit the turning motion of said turning section.

2. A switch operating rubber member according to claim 1, further comprising an electrically conductive element disposed on said turning section and having an inclined surface such that when said turning section is pressed, said electrically conductive element contacts said electrical contacts to thereby enable electrical conductivity between said electrical contacts.

3. A switch operating rubber member according to claim 1, wherein said second coupling section is formed of a thin film having an approximately conical shape or an inclined surface.

4. A switch operating rubber member according to claim 3, wherein a start height of the approximately conical surface of said second coupling section, as measured from the substrate section to said turning section, increases according to a distance of a position being measured along the periphery of the turning section relative to said first coupling section.

5. A switch operating rubber member according to claim 3, wherein the thickness of the thin film of said second coupling section having the approximately conical surface or the inclined surface is thinner than the thickness of said first coupling section.

6. A switch device comprising:

a housing section having a hole formed therein;

a swing support section composed of a rubber material;

a swing section composed of a rubber material and which is swingably turnable with respect to said swing support section, said swing section including a portion at which said swing section is pressed to activate a turning motion thereof, and further including an electrically conductive contact portion; and a press member extending through the hole for being pressed to thereby press the swing section.

7. A switch device according to claim 6, further comprising an electrical substrate including a pair of printed contacts spaced apart from each other, wherein the contact portion comes into contact with the pair of printed contacts spaced apart from each other to thereby establish electrical conduction between the pair of printed contacts.

8. A switch device according to claim 7, wherein a contact surface of the contact portion of the switch device is parallel with the printed contacts of the electrical substrate while said swing section is being pressed such that the contact surface of the contact portion comes into contact with the surfaces of the printed contacts.

9. A switch device according to claim 7, wherein the contact surface of the contact portion of the switch device is spaced apart from and is not parallel to the surfaces of the printed contacts of the electrical while said swing section is not being pressed.

10. A switch device according to claim 6, wherein the contact portion is composed of an electrically conductive rubber material.

11. A switch device according to claim 6, wherein the contact portion includes an inclined surface.

12. A switch device according to claim 6, wherein said swing section is formed integrally with said swing support section.

13. A switch device according to claim 12, wherein said swing section and said swing support section are composed of a thin film.

14. A switch device according to claim 6, wherein the portion at which said swing section is pressed and the contact portion are each formed on said swing section at positions having mutually different distances from said swing support section.

15. A switch device according to claim 14, wherein the portion at which said swing section is pressed is located at a position which is nearer to said swing support section than the contact portion.

16. A switch device according to claim 14, wherein the contact portion is located at a position which is farther from said swing support section than the portion at which said swing section is pressed.

17. A switch device according to claim 6, wherein the portion at which said swing section is pressed and the contact portion are disposed on different surfaces of said swing section.

18. A switch device comprising:

a housing section having a hole formed therein;

a base section composed of a rubber material;

a lever section composed of a rubber member and having an electrical contact;

a hinge section composed of a rubber material for swingably supporting said lever section on said base section; and a press member extending through the hole, for pressing the lever section when the press member is pressed.

19. A switch device according to claim 18, wherein the press member is formed integrally with said lever section, wherein said lever section is swung by being pressed by said press section.

20. A switch device according to claim 18, wherein said base section, said lever section and said hinge section are composed of silicone rubber.

21. A switch device according to claim 18, wherein said press member for pressing said lever section presses said lever section at a position along said lever section different from a position at which the electrical contact is disposed.

* * * * *